US006201345B1

(12) United States Patent
Nakagawa et al.

(10) Patent No.: US 6,201,345 B1
(45) Date of Patent: Mar. 13, 2001

(54) CATHODE-RAY TUBE WITH ELECTRON BEAMS OF INCREASED CURRENT DENSITY

(75) Inventors: Satoru Nakagawa, Takatsuki; Yoji Yamamoto, Nishinomiya, both of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/136,397

(22) Filed: Aug. 19, 1998

(30) Foreign Application Priority Data

Aug. 27, 1997 (JP) ..... 9-230606

(51) Int. Cl.[7] ..... H01J 29/48
(52) U.S. Cl. ..... 313/414
(58) Field of Search ..... 313/414, 447, 313/449, 451, 452

(56) References Cited

U.S. PATENT DOCUMENTS

| | | | | |
|---|---|---|---|---|
| 4,415,831 | | 11/1983 | Konosu . | |
| 4,742,279 | * | 5/1988 | Gerritsen et al. | 315/382 |
| 4,797,593 | | 1/1989 | Saito et al. | 313/346 R |
| 4,814,670 | | 3/1989 | Suzuki et al. | 315/15 |
| 4,833,364 | * | 5/1989 | Izumida et al. | 313/414 |
| 4,876,478 | | 10/1989 | Morohashi et al. . | |
| 4,886,999 | | 12/1989 | Yamane et al. | 313/414 |
| 4,945,283 | | 7/1990 | Van Der Heijden et al. | 313/450 |
| 4,945,284 | | 7/1990 | Shimoma et al. | 313/414 |
| 5,519,290 | | 5/1996 | Sugawara et al. | 315/382.1 |
| 5,675,211 | | 10/1997 | Ueda | 313/412 |
| 5,773,925 | | 6/1998 | Kimura et al. | 313/414 |
| 5,818,157 | * | 10/1998 | Stil et al. | 313/414 |
| 5,905,332 | * | 5/1999 | Yun et al. | 313/414 |
| 5,942,847 | | 8/1999 | Roth | 313/456 |

FOREIGN PATENT DOCUMENTS

| | | |
|---|---|---|
| 0 646 944 A2 | 4/1995 | (EP) . |
| 55-21832 | 2/1980 | (JP) . |
| 55-141051 | 11/1980 | (JP) . |
| 59-111237 | 6/1984 | (JP) . |
| 61-99249 | 5/1986 | (JP) . |
| 1-232643 | 9/1989 | (JP) . |
| 2-106855 | 4/1990 | (JP) . |
| 3-93135 | 4/1991 | (JP) . |
| 3-95835 | 4/1991 | (JP) . |
| 3-233839 | 10/1991 | (JP) . |
| 3-283236 | 12/1991 | (JP) . |
| 7-6707 | 1/1995 | (JP) . |
| 7-6709 | 1/1995 | (JP) . |
| 7-226170 | 8/1995 | (JP) . |
| 8-22779 | 1/1996 | (JP) . |

* cited by examiner

*Primary Examiner*—Ashok Patel
(74) *Attorney, Agent, or Firm*—Merchant & Gould P.C.

(57) ABSTRACT

A cathode-ray tube with high image quality in which electron beams with higher current density than the electron-emitting ability of cathodes are formed and a driving voltage of the cathodes can be decreased. A cathode-ray tube comprises a glass face-panel, a glass funnel connected to the rear part of the face-panel, and an electron gun for emitting electron beams that is contained in a neck portion of the funnel. On the peripheral surface of the funnel, a deflection yoke for deflecting the electron beams emitted from the electron gun is mounted. A phosphor dot for three colors of red, green and blue is applied on the inner surface of the face-panel, thus forming a phosphor screen surface. In the vicinity of the inner surface of the face-panel, a shadow mask is arranged substantially in parallel with the phosphor screen surface. Between the phosphor screen surface of the face-panel and the cathodes in the electron gun, a means for superimposing a plurality of electron beams on the predetermined phosphor dot is provided.

11 Claims, 7 Drawing Sheets

CATHODE-RAY TUBE WITH ELECTRON BEAMS OF INCREASED CURRENT DENSITY

FIELD OF THE INVENTION

The present invention relates to cathode-ray tubes used in television receivers, computer-displays or the like.

BACKGROUND OF THE INVENTION

A conventional cathode-ray tube comprises a glass bulb having phosphors for red, green and blue inside and an electron gun that emits electron beams inside the glass bulb. This electron gun comprises cathodes, a first control electrode, a second control electrode, and a third control electrode. The cathodes emit a plurality of electron beams having an inline alignment in the horizontal direction. The first control electrode has first electron-beam through holes opposing the respective cathodes. The second control electrode has second electron-beam through holes provided at positions opposing the respective first electron-beam through holes. The third control electrode has third electron-beam through holes provided at positions opposing the respective second electron-beam through holes.

In cathode-ray tubes, the important factors for determining the image quality are the spot diameter of electron beams striking phosphors and the current value of the electron beams in general. That is to say, the smaller the spot diameter of the electron beams is, the more the resolution is improved. The higher the current value of the electron beams is, the higher the brightness of phosphors becomes. Consequently, bright and clear image pictures can be obtained.

However, in the conventional cathode-ray tube described above, when making the spot diameter of the electron beams small and setting the current value of the electron beams high at the same time, the current density of the current obtained from cathodes becomes high. Consequently, the electron emission from the cathodes becomes difficult, thus limiting the picture image to have high brightness. In addition, the driving voltage of the cathodes becomes high, thus causing problems such as a great burden on a driving circuit. On the contrary, when controlling the current density of the current obtained from the cathodes to a predetermined level or less and increasing the current value of the electron beams, the spot diameter of the electron beams becomes larger, thus causing such problems that the high resolution of image pictures is difficult to obtain.

SUMMARY OF THE INVENTION

The object of the present invention is to solve the above-mentioned problems in the conventional technique and to provide a cathode-ray tube with a high image quality in which an electron beam with a current density higher than the electron-emitting ability of a cathode is formed and the driving voltage of the cathode can be decreased.

In order to attain the object mentioned above, a cathode-ray tube of the present invention comprises: a face-panel having a phosphor screen surface on its inner surface; a funnel connected to the rear part of the face-panel; and an electron gun that is contained in a neck portion of the funnel and emits electron beams. The cathode-ray tube is provided with means for superimposing a plurality of electron beams on a predetermined phosphor on the phosphor screen surface. According to this configuration of the cathode-ray tube, the plurality of electron beams are superimposed and emitted on the predetermined phosphor on the phosphor screen surface. Therefore, while the spot diameter of the electron beams is kept small, the brightness of the phosphor can be improved greatly. As a result, a cathode-ray tube with high brightness and high resolution can be obtained.

In the configuration of the cathode-ray tube of the present invention, it is preferable that the means for superimposing the electron beams is provided between the phosphor screen surface and the cathodes in the electron gun.

In the configuration of the cathode-ray tube of the present invention, it is preferable that the plurality of electron beams are obtained from one cathode in the electron gun. According to this preferable example, electron beams superimposed with a higher current density than the electron-emitting ability in one cathode can be formed without increasing the driving voltage of the one cathode. As a result, the burden on the driving circuit of the cathode can be reduced.

In the configuration of the cathode-ray tube of the present invention, it is preferable that the electron gun is provided with a means for superimposing electron beams. In this case, it is preferable that the electron gun comprises cathodes, a first control electrode, a second control electrode, and a third control electrode. The cathodes emit electron beams. The first control electrode has a plurality of first electron-beam through holes provided at the positions opposing the respective cathodes and are aligned in the perpendicular direction with respect to the horizontal scanning line direction of the electron beams. The second control electrode has second electron-beam through holes provided at the positions opposing the respective first electron-beam through holes. The third control electrode has third electron-beam through holes provided at the positions opposing the respective second electron-beam through holes. According to this preferable example, a cathode-ray tube with high resolution and high brightness can be obtained using the same number of parts as in a conventional one. In this case, it is further preferable that the cathode has a plurality of electron emitting parts opposing the respective first electron-beam through holes aligned in the perpendicular direction with respect to the horizontal scanning line of the electron beams.

Furthermore, in this example, it is preferable that the pitch of the plurality of third electron-beam through holes aligned in the perpendicular direction with respect to the horizontal scanning line of the electron beams of the third control electrode is set to be narrower than that of the plurality of second electron-beam through holes aligned in the perpendicular direction with respect to the horizontal scanning line of the electron beams of the second control electrode. According to this preferable example, an electron lens can be formed of the second control electrode and the third control electrode.

Further, in this case, it is preferable that three electron-beam through holes are aligned in the perpendicular direction with respect to the horizontal scanning line direction of the electron beams of each control electrode. Moreover, it is preferable that the diameters of the electron-beam through holes located at the upper and lower sides are set to be smaller than that of the electron-beam through hole located in the middle. According to this preferable example, the aberration of the electron beams passing through the electron-beam through holes located at the upper and lower sides can be decreased.

In this case, it is further preferable that the electron gun comprises a plurality of cathodes, a first control electrode, a second control electrode, and a third control electrode. The plurality of cathodes for emitting electron beams have an inline alignment in the horizontal direction. The first control electrode has a plurality of first electron-beam through holes opposing the respective plurality of cathodes and being aligned in the perpendicular direction with respect to the horizontal scanning line direction of the electron beams. The second control electrode has second electron-beam through holes provided at the positions opposing the respective first electron-beam through holes. The third control electrode has third electron-beam through holes provided at the positions opposing the respective second electron-beam through holes. According to this preferable example, a cathode-ray tube with high resolution and high brightness can be obtained using the same number of parts as in a conventional one.

In this case, it is further preferable that the pitch of the plurality of third electron-beam through holes aligned in the perpendicular direction with respect to the horizontal scanning line of the electron beams of the third control electrode is set to be narrower than that of the plurality of second electron-beam through holes aligned in the perpendicular direction with respect to the horizontal scanning line of the electron beams of the second control electrode. Further, in this case, it is preferable that three electron-beam through holes aligned in the perpendicular direction with respect to the horizontal scanning line direction of the electron beams of each control electrode are provided. Moreover, it is preferable that the diameters of the electron-beam through holes located at the upper and lower sides are set to be smaller than that of the through hole located in the middle.

In this case, it is preferable that the electron gun comprises cathodes, a first control electrode, a second control electrode and a third control electrode. The cathodes have a plurality of electron emitting parts for emitting electron beams. The first control electrode has a first electron-beam through hole common for the plurality of electron emitting parts. The second control electrode has a second electron-beam through hole provided at the position opposing the first electron-beam through hole. The third control electrode has a third electron-beam through hole provided at the position opposing the second electron-beam through hole. According to this preferable example, a cathode-ray tube with high resolution and high brightness can be obtained using the same number of parts as in a conventional one, and the time required for the punching process of the control electrodes can be shortened. In this case, it is further preferable that the diameter of the third electron-beam through hole is set to be smaller than that of the second electron-beam through hole. According to this preferable example, the second control electrode and the third control electrode can form an electron lens.

In this case, it is preferable that the electron gun comprises a plurality of cathodes, a first electrode, a second electrode and a third electrode. The plurality of cathodes have an inline alignment in the horizontal direction and each of the plurality of cathodes has a plurality of electron emitting parts for emitting electron beams. The first control electrode has first electron-beam through holes opposing the plurality of cathodes. Each of the first electron-beam through holes is common for the plurality of electron emitting parts aligned in the perpendicular direction with respect to the horizontal scanning line direction of the electron beams. The second control electrode has second electron-beam through holes provided at the position opposing the first electron-beam through holes respectively. The third control electrode has third electron-beam through holes provided at the position opposing the second electron-beam through holes respectively. According to this preferable example, a cathode-ray tube with high resolution and high brightness can be obtained using the same number of parts as in a conventional one, and the time required for the punching process of the control electrodes can be shortened. Further, in this case, it is preferable that the diameter of the third electron-beam through hole is set to be smaller than that of the second electron-beam through hole.

DETAILED DESCRIPTION OF THE INVENTION

The present invention will be explained further in detail referring to embodiment as follows.

Figure 1:
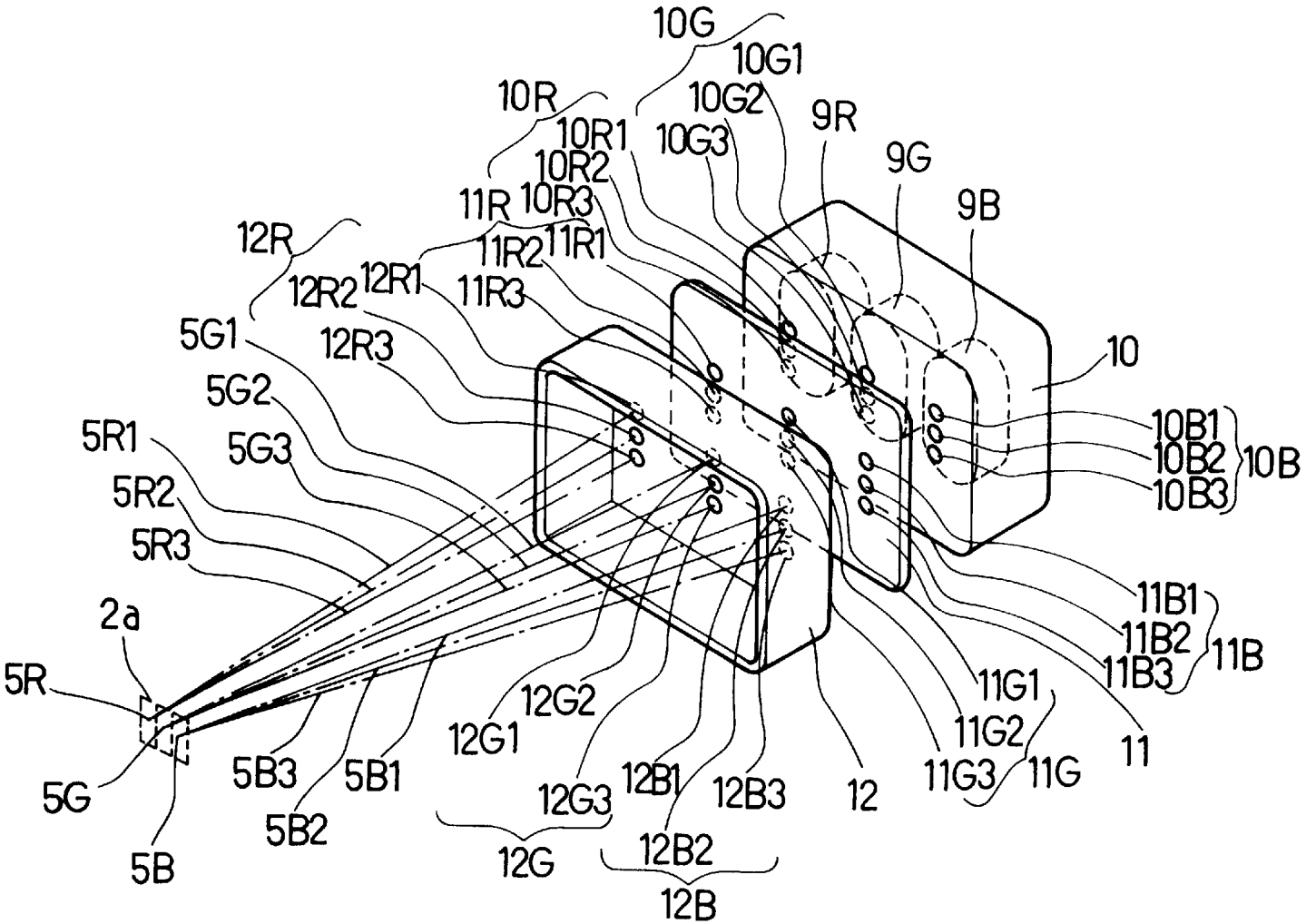
FIG. 1 is a perspective view showing an electron gun in a cathode-ray tube in an embodiment of the present invention.
Figure 2:
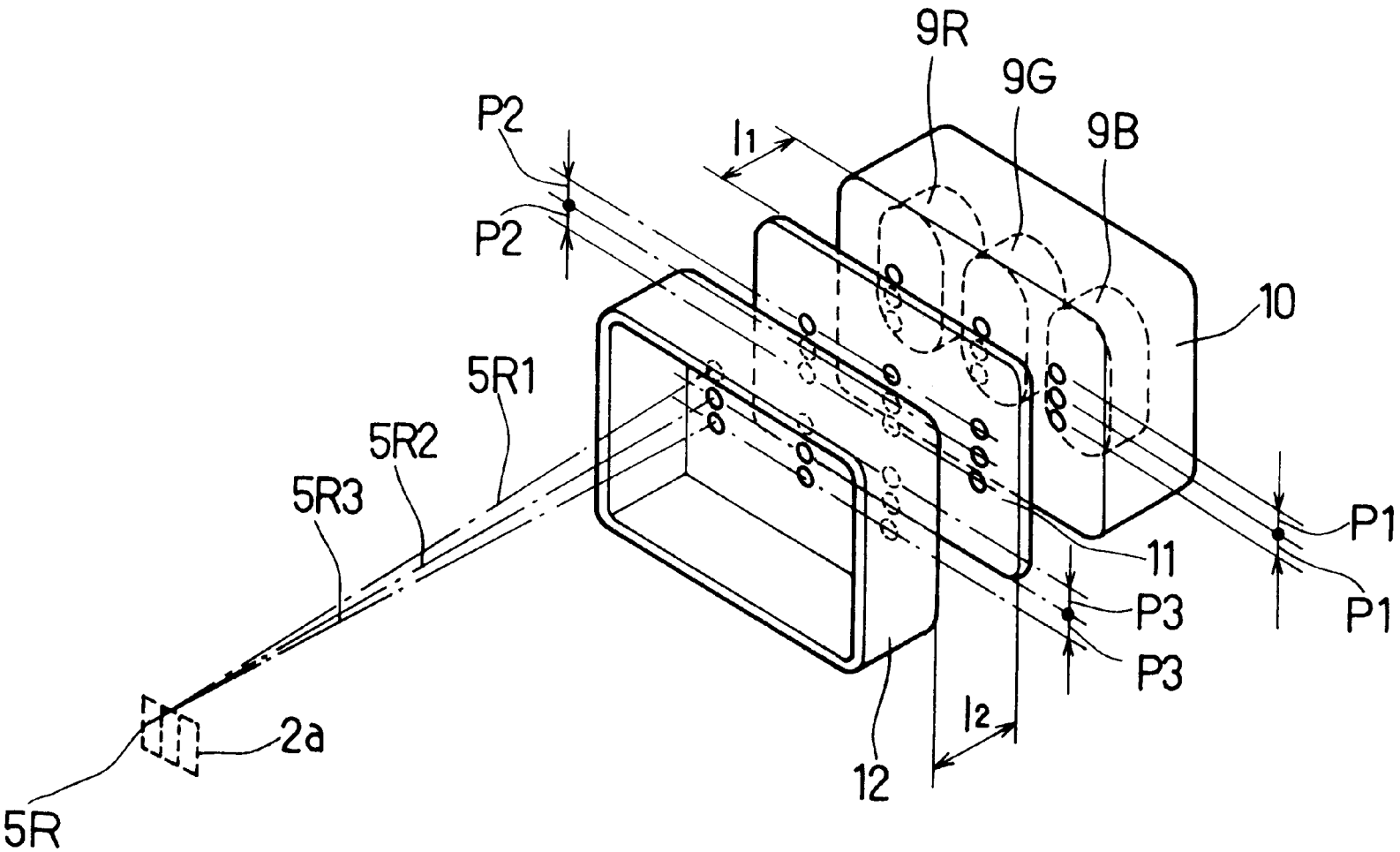
FIG. 2 is a perspective view showing each size of the electron gun in a cathode-ray tube in an embodiment of the present invention.
Figure 3:
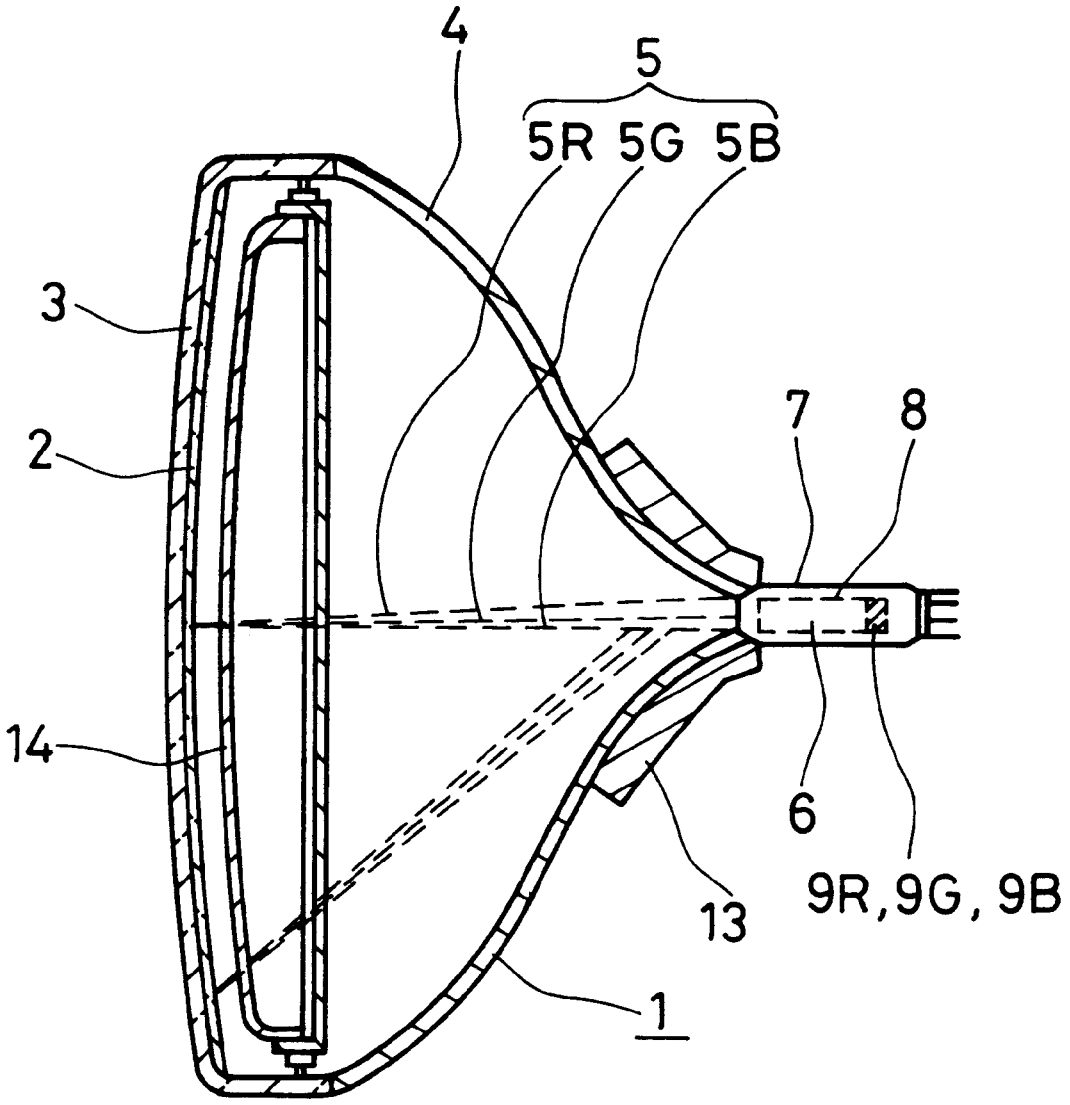
FIG. 3 is a cross-sectional view showing a cathode-ray tube in an embodiment of the present invention.

FIG. 1 is a perspective view showing an electron gun in a cathode-ray tube in an embodiment of the present invention. FIG. 2 is a perspective view showing dimentions of the electron gun in the same cathode-ray tube. FIG. 3 is a cross-sectional view showing a cathode-ray tube in an embodiment of the present invention.

As shown in FIGS. 1 and 3, a cathode-ray tube 1 according to this embodiment comprises a glass face-panel 3, a glass funnel 4 connected to the rear part of the face-panel 3, and an electron gun 6 for emitting electron beams 5 that is contained in a neck portion 7 of the funnel 4. On the peripheral surface of the funnel 4 of the cathode-ray tube 1, a deflection yoke 13 for deflecting the electron beams 5 emitted from the electron gun 6 is mounted. Phosphor dots 2*a* for three colors of red, green and blue are applied on the inner surface of the face-panel 3, thus forming a phosphor screen surface 2. In the vicinity of the inner surface (phosphor screen surface 2) of the face-panel 3, a shadow mask 14 is arranged substantially in parallel with the phosphor screen surface 2. Between the phosphor screen surface 2 of the face-panel 3 and cathodes 9R, 9G and 9B in the electron gun 6, a means 8 for superimposing a plurality of electron beams 5R, 5G and 5B on the predetermined phosphor dot 2*a* is provided.

The configuration of the electron gun 6 with the means 8 will be described as follows. The electron gun 6 comprises the three cathodes 9R, 9G and 9B, a box-like first control electrode 10, a plate-like second control electrode 11, and a box-like third control electrode 12 (in FIG. 1, a part of the electrode 12 is omitted at the side of the phosphor dots 2*a*). The three cathodes 9R, 9G and 9B are used for emitting the electron beams 5R, 5G and 5B for red, green and blue having an inline alignment in the horizontal direction. The first control electrode 10 is arranged opposing the cathodes 9R, 9G and 9B and has an opening on the side of the cathodes 9R, 9G and 9B. The second control electrode 11 is arranged opposing the first control electrode 10. The third control electrode 12 is arranged opposing the second control electrode 11 and has an opening on the side of the phosphor dots 2*a*.

In the first control electrode 10, first electron-beam through holes 10R, 10G and 10B are provided at the positions opposing the cathodes 9R, 9G and 9B respectively. The first through hole 10R comprises three round holes 10R1, 10R2 and 10R3 aligned in the perpendicular direction (vertical direction) with respect to the horizontal scanning direction of the electron beams 5. As in the first through hole 10R, the first through holes 10G and 10B also comprise three round holes 10G1, 10G2 and 10G3 and 10B1, 10B2 and 10B3 aligned in the perpendicular direction (vertical direction) with respect to the horizontal scanning direction of the electron beams 5 respectively.

The second control electrode 11 comprises second electron-beam through holes 11R, 11G and 11B provided at the positions opposing the first through holes 10R, 10G and 10B provided in the first control electrode 10 respectively. The second through hole 11R comprises three round holes 11R1, 11R2 and 11R3 aligned in the perpendicular direction (vertical direction) with respect to the horizontal scanning direction of the electron beams 5. As in the second through hole 11R, the second through holes 11G and 11B also comprise three round holes 11G1, 11G2 and 11G3 and 11B1, 11B2 and 11B3 aligned in the perpendicular direction (vertical direction) with respect to the horizontal scanning direction of the electron beams 5 respectively. In this case, the holes 11R1-11B3 provided in the second control electrode 11 are arranged opposing the holes 10R1-10B3 provided in the first control electrode 10, respectively.

The third control electrode 12 comprises third electron-beam through holes 12R, 12G and 12B provided at the positions opposing the second through holes 11R, 11G and 11B provided in the second control electrode 11 respectively. The third through hole 12R comprises three round holes 12R1, 12R2 and 12R3 aligned in the perpendicular direction (vertical direction) with respect to the horizontal scanning direction of the electron beams 5. As in the third through hole 12R, the third through holes 12G and 12B also comprise three round holes 12G1, 12G2 and 12G3 and 12B1, 12B2 and 12B3 aligned in the perpendicular direction (vertical direction) with respect to the horizontal scanning direction of the electron beams 5 respectively. In this case, the holes 12R1-12B3 provided in the third control electrode 12 are arranged opposing the holes 11R1-11B3 provided in the second control electrode 11, respectively.

The substantial diameter of the electron beams 5R, 5G and 5B on the irradiated phosphor surface is called a "spot diameter". The spot diameter is the diameter of the spot obtained by projecting the electron-emitting surface of the cathodes 9R, 9G and 9B. The current values of the electron beams 5R, 5G and 5B are modulated to desired values by modulating the positive voltage applied to the cathodes 9R, 9G and 9B in a driving circuit.

As shown in FIG. 2, an electron lens is formed of the second control electrode 11 and the third control electrode 12. In order to superimpose the three electron beams 5R1–5R3 (5G1–5G3, 5B1–5B3) at one point on the predetermined phosphor dot 2*a*, the pitch P3 in the vertical direction of the third through holes 12R1–12R3 (12G1–12G3, 12B1–12B3) in the third control electrode 12 is set to be narrower than the pitch P1 in the vertical direction of the first through holes 10R1–10R3 (10G1–10G3, 10B1–10B3) in the first control electrode 10 and the pitch P2 in the vertical direction of the second through holes 11R1–11R3 (11G1–11G3, 11B1–11B3) in the second control electrode 11. That is to say, the through holes 12R1, 12R3 (12G1, 12G3, 12B1 and 12B3) located at the upper and lower sides are shifted toward the through hole 12R2 (12G2 and 12B2) located in the middle. In order to decrease the aberration of the electron beams 5R1 and 5R3 (5G1 and 5G3, 5B1 and 5B3) that pass through the first through holes 10R1 and 10R3 (10G1 and 10G3, 10B1 and 10B3) located at the upper and lower sides, the diameters of the first through holes 10R1 and 10R3 (10G1 and 10G3, 10B1 and 10B3) located at the upper and lower sides are set to be smaller than that of the first through hole 10R2 (10G2, 10B2) located in the middle. Similarly, the diameters of the second and third through holes 11R1 and 11R3 (11G1 and 11G3, 11B1 and 11B3) and 12R1 and 12R3 (12G1 and 12G3, 12B1 and 12B3) located at the upper and lower sides are set to be smaller than those of the second and third through holes 11R2 (11G2, 11B2) and 12R2 (12G2, 12B2) located in the middle respectively.

Next, the operation of the cathode-ray tube with the configuration described above will be explained.

Electrons emitted from the cathodes 9R, 9G and 9B are formed into cross-sectional round shape electron beams through the first through holes 10R1-10B3 in the first control electrode 10 respectively. Each of the electron beams 5Rl, 5R2, 5R3, 5G1, 5G2, 5G3, 5B1, 5B2 and 5B3 formed into cross-sectional round shapes is emitted from the first control electrode 10. Then, each of the electron beams 5R1-5B3 is accelerated by the second control electrode 11. Each group of three electron beams with each one color (5R1–5R3, 5G1–5G3 or 5B1–5B3) aligned in the vertical direction is superimposed to one beam by the electron lens formed of the second control electrode 11 and the third control electrode 12. Each of the electron beams 5R, 5G and 5B with one color superimposed is scanned in the horizontal direction, and then is irradiated on a predetermined phosphor dot 2*a*. Thus, a color image is obtained.

According to this embodiment, since the means 8 for superimposing electron beams is provided, each group of three electron beams with each one color 5R1–5R3, 5G1–5G3 or 5B1–5B3 aligned in the vertical direction is superimposed into one beam. Each electron beam with one color 5R, 5G or 5B superimposed is irradiated to the predetermined phosphor dot 2*a* corresponding to each color. Consequently, compared to a conventional cathode-ray tube, the brightness of the phosphor dot 2*a* can be improved greatly, while the spot diameters of the electron beams 5R, 5G and 5B are kept small. As a result, the cathode-ray tube 1 with high brightness and high resolution can be obtained. In addition, without increasing the driving voltage of the cathodes 9R, 9G and 9B, the electron beams 5R, 5G and 5B with higher current density than the electron-emitting ability of the cathodes 9R, 9G and 9B can be formed, thus reducing the burden on the driving circuit of the cathodes 9R, 9G and 9B. That is to say, the driving circuit can be simplified. In the case of setting the brightness of the phosphor dot 2*a* to be the same as that in a conventional cathode-ray tube, the spot diameters of the electron beams 5R, 5G and 5B become further smaller, and therefore the cathode-ray tube 1 with high resolution can be obtained.

According to this embodiment, after obtaining three electron beams 5R1–5R3 (5G1–5G3 and 5B1–5B3) from one cathode 9R through the first through holes 10R1–10R3 (10G1–10G3 and 10B1–10B3) aligned in the vertical direction in the first control electrode 10, these three electron beams 5R1–5R3 (5G1–5G3 and 5B1–5B3) are superimposed by the electron lens formed of the second control electrode 11 and the third control electrode 12, thus forming the electron beam 5R (5G and 5B). Consequently, the electron beams 5R, 5G and 5B with high current density can be formed without going beyond the electron-emitting ability of the cathodes 9R, 9G and 9B. As a result, the cathode-ray tube 1 with high brightness can be obtained.

According to the present embodiment, the means 8 for superimposing electron beams can be obtained by only making a modification so as to increase the number of the electron-beam through holes in the first, second and third control electrodes forming a conventional inline electron gun in the vertical direction. Therefore, the cathode-ray tube 1 with high resolution and high brightness can be obtained using the same number of parts as in a conventional one.

Next, the present invention will be explained further in detail referring to a concrete embodiment.

In this embodiment, a cathode-ray tube for a 28-inch television having the structure shown in FIGS. 1 and 3 was manufactured.

In the first control electrode 10, each diameter of the first through holes 10R2, 10G2 and 10B2 located in the middle was set to be 0.5 mm. Each diameter and pitch P1 of the first through holes 10R1, 10R3, 10G1, 10G3, 10B1 and 10B3 located at the upper and lower sides were 0.35 mm and 0.95 mm, respectively. In the second control electrode 11, each diameter of the second through holes 11R2, 11G2 and 11B2 located in the middle was set to be 0.5 mm. Each diameter and pitch P2 of the second through holes 11R1, 11R3, 11G1, 11G3, 11B1 and 11B3 located at the upper and lower sides were 0.35 mm and 0.95 mm, respectively. In the third control electrode 12, each diameter of the third through holes 12R2, 12G2 and 12B2 located in the middle was set to be 0.9 mm. Each diameter and pitch P3 of the third through holes 12R1, 12R3, 12G1, 12G3, 12B1 and 12B3 located at the upper and lower sides were 0.8 mm and 0.9 mm, respectively. The distance $l_1$ between the first control electrode 10 and the second control electrode 11 was 0.28 mm. The distance $l_2$ between the second control electrode 11 and the third control electrode 12 was 1 mm. The anode voltage was 29.5 kV. The voltage of the second control voltage 11 and the third control electrode 12 were 930 V and 8.3 kV, respectively. The cut-off voltage of the cathodes 9R, 9G and 9B was set to be 190V.

For the purpose of making a comparison with the embodiment mentioned above, a conventional cathode-ray tube having the same structure as the embodiment described above except removing the first through holes 10R1, 10R3, 10G1, 10G3, 10B1 and 10B3, the second through holes 11R1, 11R3, 11G1, 11G3, 11B1 and 11B3 and the third through holes 12R1, 12R3, 12G1, 12G3, 12B1 and 12B3 located at the upper and lower sides also was manufactured.

In the cathode-ray tube of the present embodiment (hereafter referred to as "the present product") and the conventional cathode-ray tube (hereafter referred to as "the conventional product"), the following results were obtained by examining the relationships between the anode current and the spot diameter of electron beams and between the cathode driving voltage and the anode current.

Figure 4:
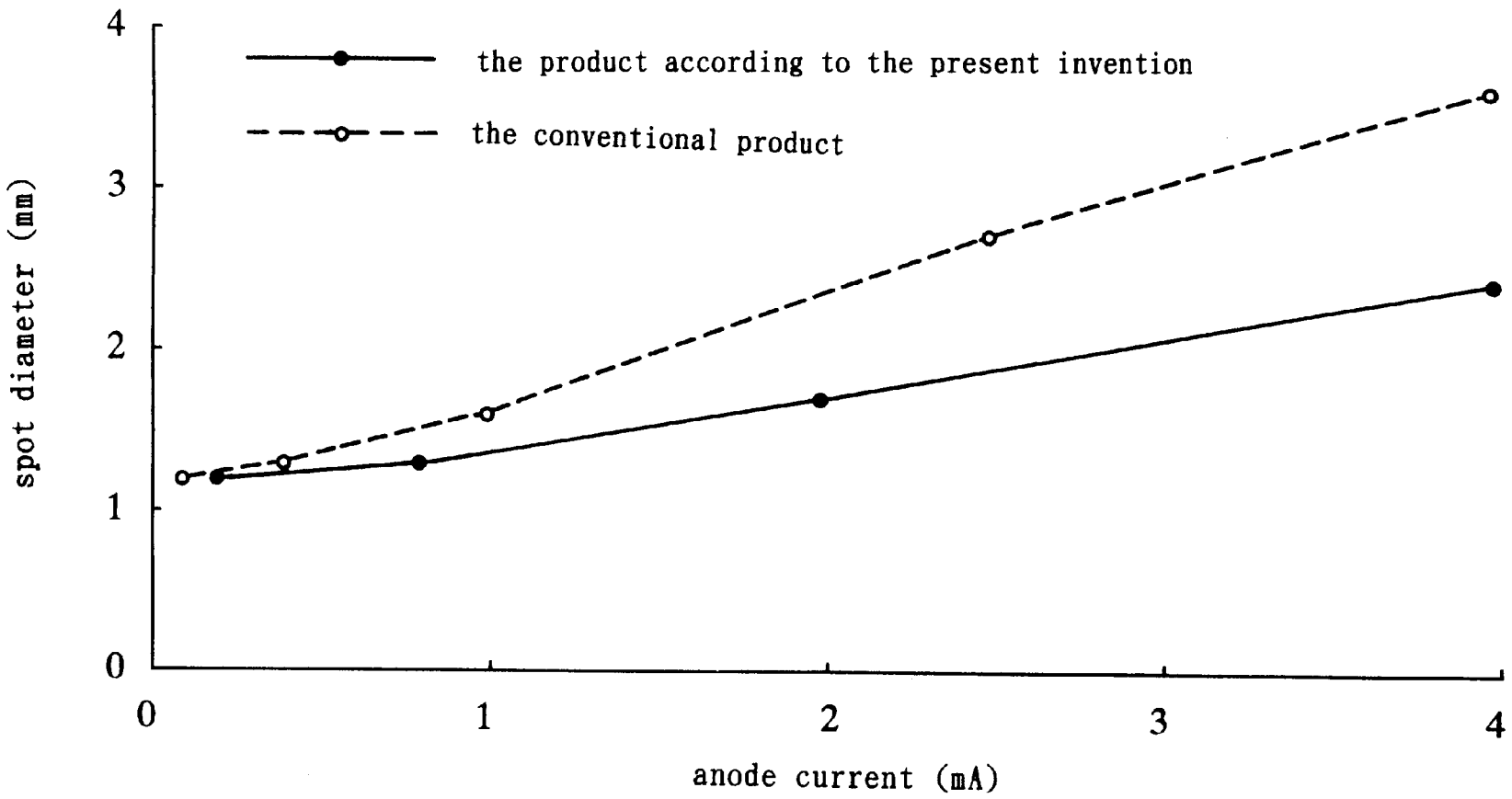
FIG. 4 is a graph showing the relationship between anode current and the spot diameter of an electron beam in a cathode-ray tube in an embodiment of the present invention in comparison with that in a conventional cathode-ray tube.

FIG. 4 shows the relationship between the anode current and the spot diameter of electron beams when changing the driving voltage of the cathode 9R. The anode current value is proportional to the brightness of a picture image. The spot diameter is evaluated by the vertical diameter in the middle part of a screen. The smaller the spot diameter is, the higher the resolution of the picture image becomes. In FIG. 4, the solid line and the broken line show the characteristics of the present product and of the conventional product, respectively.

As shown in FIG. 4, the spot diameter of electron beams in the present product is about 1.5 mm under a low current of 1 mA or less, which is almost the same size as that in the conventional product. However, it is about 1.7 mm under a current of 2 mA, which is smaller by about 26% compared to that of about 2.3 mm in the conventional product. In the case of applying a current of 4 mA, the spot diameter is 2.4 mm and is smaller by about 33% compared to that of 3.6 mm in the conventional product. That is to say, according to the configuration of the present product, higher resolution can be obtained.

The anode current of the present product is about 1.4 mA when the spot diameter is 1.5 mm, which is about 1.75 times as high as that of about 0.8 mA in the conventional product. When the spot diameter is 2.0 mm, the anode current of the present product is about 2.8 mA, which is about 1.9 times as high as that of about 1.5 mA in the conventional product. Thus, according to the configuration of the present product, higher anode current than that in the conventional product can be obtained. That is, according to the configuration of the present product, for example, when the spot diameter is 1.5 mm, the brightness can be improved to about 1.75 times as high as that in the conventional product.

Furthermore, for instance, when 1.4 mA of the anode current is obtained from the cathode 9R, in the present product the anode current value of the electron beam passing through the first through hole 10R2 located in the middle having a diameter of 0.5 mm is about 0.8 mA, and the current density obtained from the cathode surface is about 0.4 A/cm$^2$. The anode current value of electron beams passing through the first through holes 10R1 and 10R3 located at the upper and lower sides having a diameter of 0.35 mm is about 0.3 mA and the current density obtained from the cathode surface is about 0.3 A/cm$^2$.

On the other hand, in the conventional product, when 1.4 mA of the anode current is obtained from each of the cathodes 9R, 9G and 9B, the current density of the electron beams passing through the first, second and third electron-beam through holes having a diameter of 0.5 mm is about 0.7 A/cm$^2$.

As described above, when using the present product, about 0.3–0.4 A/cm$^2$ of the current density can be obtained, which is half the current density of about 0.7 A/cm$^2$ in the conventional product. Therefore, the burden on the cathode 9R can be reduced.

Figure 5:
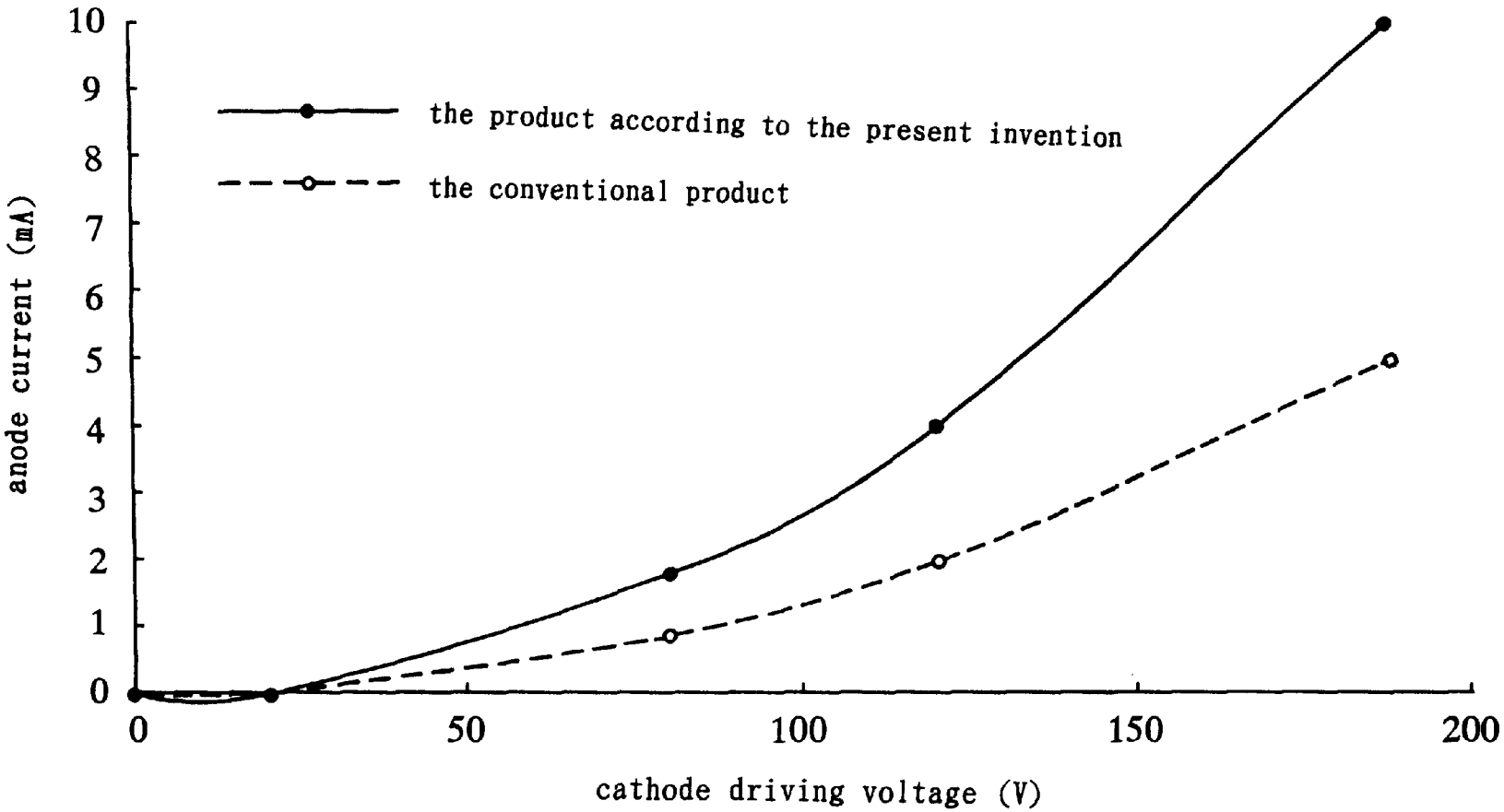
FIG. 5 is a graph showing the relationship between anode current and the cathode driving voltage in a cathode-ray tube in an embodiment of the present invention in comparison with that in a conventional cathode-ray tube.

FIG. 5 shows the relationship between the cathode driving voltage and the anode current. In FIG. 5, the solid line and the broken line show the characteristics of the present product and of the conventional product, respectively. The greater slope of the curve shows the greater current modulation under a low driving voltage.

As shown in FIG. 5, the anode current value of the present product is about 0.8 mA when the cathode driving voltage is 50V, which is about twice the value of about 0.4 mA in the conventional product. The anode current value of the present product is about 2.7 mA when the cathode driving voltage is 100V, which is about twice the value of about 1.4 mA in the conventional product. Further, the anode current value of the present product is about 6.5 mA when the cathode driving voltage is 150V, which is about twice the value of about 3.3 mA in the conventional product. That is to say, it can be found that the present product is a cathode-ray tube with brightness twice as high as that in the conventional product. The reason of obtaining such brightness is because the electron beams 5R with high current density can be formed without going beyond the electron-emitting ability of the cathode 9R by obtaining three electron beams 5R1–5R3 from one cathode 9R.

The cathode driving voltage of the present product is, for example, about 80 V when 2 mA of the anode current is obtained, which is about 67% of that of about 120 V in the conventional product. The cathode driving voltage of the present product is about 130 V when 5 mA of the anode current is obtained, which is about 68% of that of about 190 V in the conventional product. That is to say, according to the present product, a greater current modulation can be obtained with a smaller cathode driving voltage than that in the conventional product. Therefore, when using the present product, the cathode driving voltage (cathode cut-off voltage) can be reduced to about 70% of that in the conventional product.

In the embodiment described above, the explanation was made by referring to the color cathode-ray tube 1. However, the present invention can be applied not only to a color cathode-ray tube but also other cathode-ray tubes such as a monochrome cathode-ray tube, a mono-color cathode-ray tube and the like.

Figure 6:
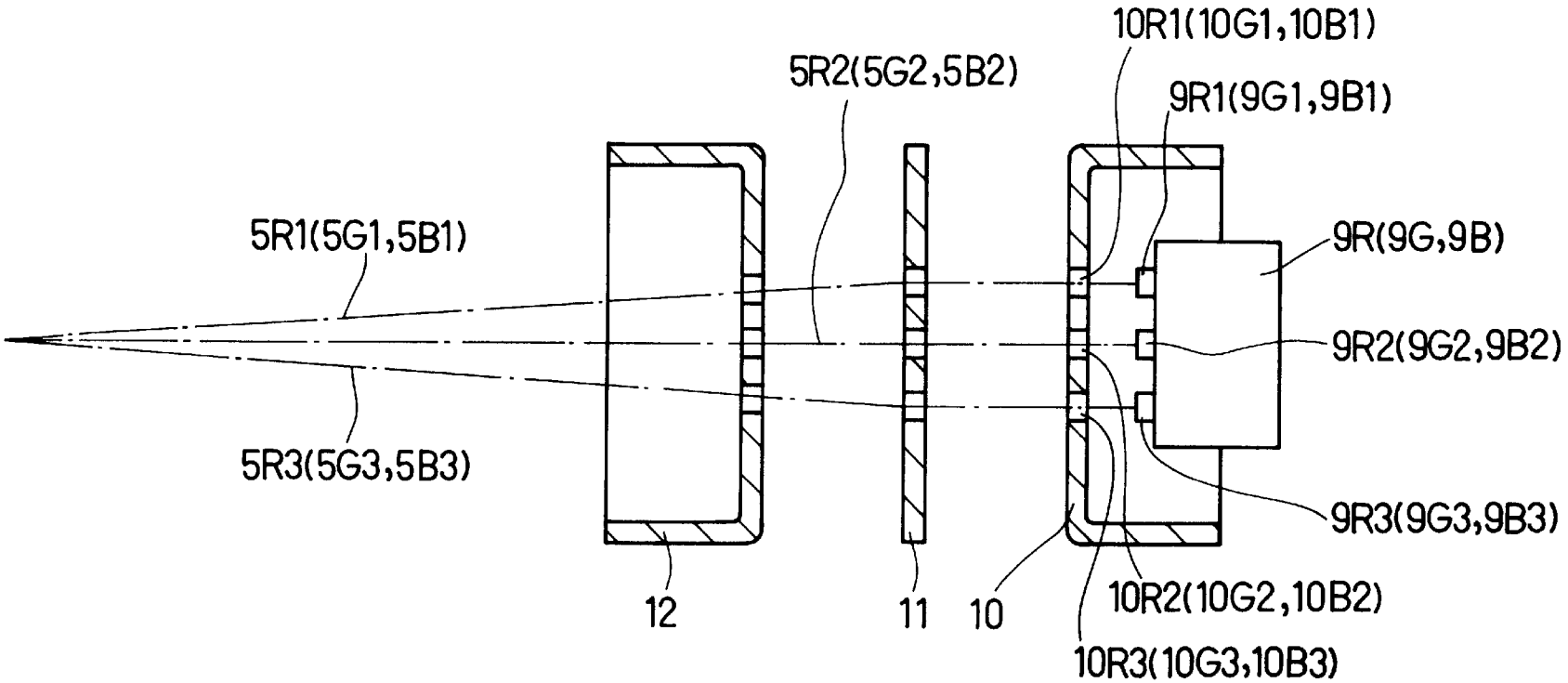
FIG. 6 is a cross-sectional view showing another configuration of a means for superimposing electron beams in a cathode-ray tube in an embodiment of the present invention.
Figure 7:
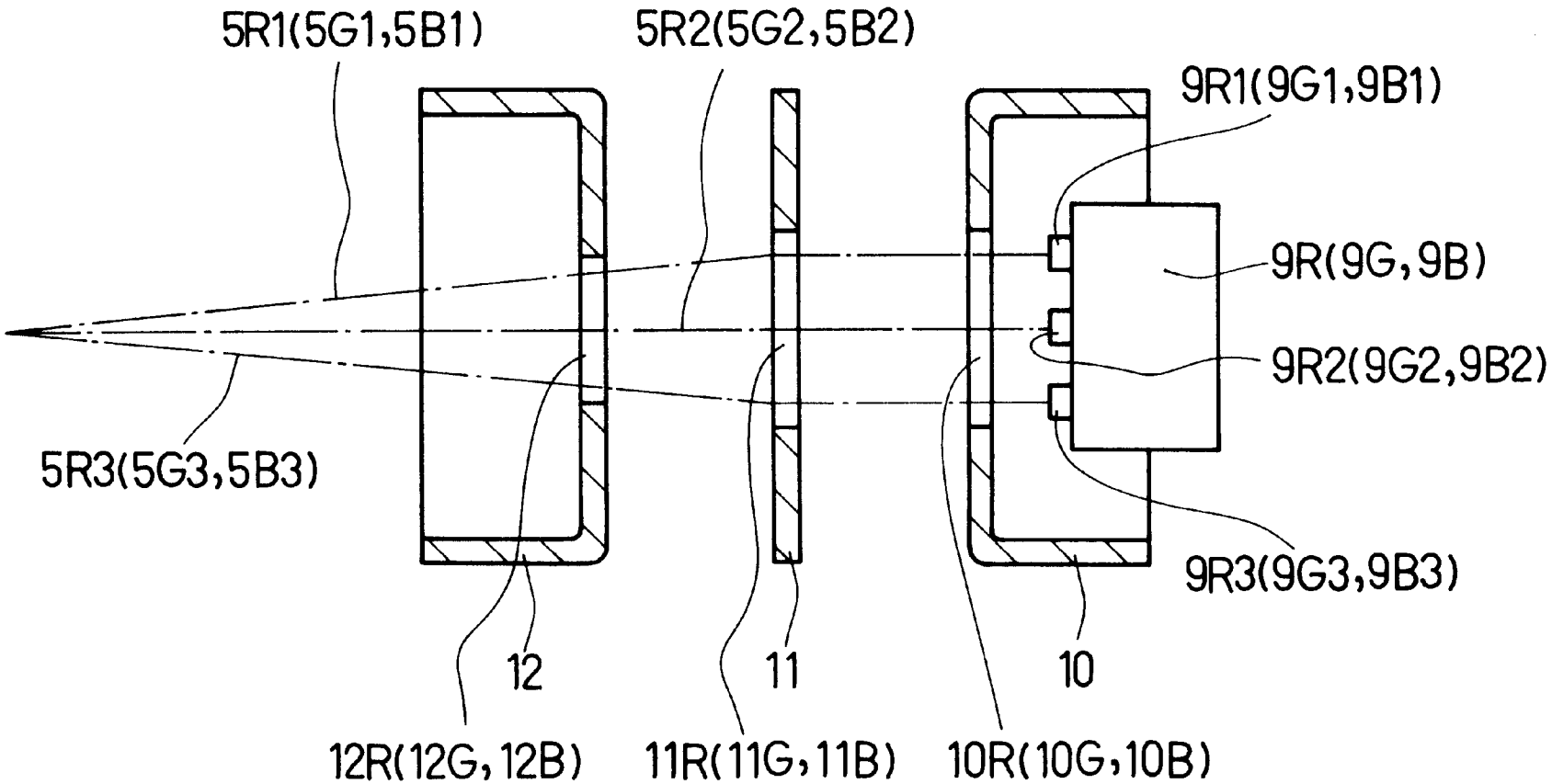
FIG. 7 is a cross-sectional view showing further another configuration of a means for superimposing electron beams in a cathode-ray tube in an embodiment of the present invention.

In the embodiment described above, the means 8 for superimposing three electron beams obtained from one cathode on the predetermined phosphor dot was explained as an example. However, the means is not always limited to such a configuration. The means may be formed so as to superimpose two electron beams or four or more electron beams obtained from one cathode on a predetermined phosphor dot. Further, the means may be formed so as to superimpose each of the electron beams obtained as follows on a predetermined phosphor dot. As shown in FIG. 6, cathode 9R (9G and 9B) is provided with a plurality of electron emitting parts 9R1, 9R2 and 9R3 (9G1, 9G2 and 9G3, and 9B1, 9B2 and 9B3) opposing first electron-beam through holes 10R1, 10R2 and 10R3 (10G1, 10G2 and 10G3, and 10B1, 10B2 and 10B3) respectively, thus obtaining the plurality of electron beams 5R1, 5R2 and 5R3 (5G1, 5G2 and 5G3, and 5B1, 5B2 and 5B3) from the cathode 9R (9G and 9B). Moreover, the means may be formed so as to superimpose each of electron beams obtained as follows on a predetermined phosphor dot. As shown in FIG. 7, the cathode 9R (9G and 9B) is provided with the plurality of electron emitting parts 9R1, 9R2 and 9R3 (9G1, 9G2 and 9G3, and 9B1, 9B2 and 9B3), and each control electrode is provided with an electron beam through hole common for the plurality of electron emitting parts 9R1, 9R2 and 9R3 (9G1, 9G2 and 9G3, and 9B1, 9B2 and 9B3), thus obtaining the plurality of electron beams 5R1, 5R2 and 5R3 (5G1, 5G2 and 5G3, and 5B1, 5B2 and 5B3) from the electrode 9R (9G and 9B). In this case, a first control electrode 10 is provided with a first electron-beam through hole 10R (10G and 10B) common for the plurality of electron emitting parts 9R1, 9R2 and 9R3 (9G1, 9G2 and 9G3, and 9B1, 9B2 and 9B3). A second control electrode 11 is provided with a second electron-beam through hole 11R (11G and 11B) opposing the first through hole 10R (10G and 10B). A third control electrode 12 is provided with a third electron-beam through hole 12R (12G and 12B) opposing the second through hole 11R (11G and 11B). In this case, in order to form an electron lens with the second electrode 11 and the third electrode 12, the diameter of the third through hole 12R (12G and 12B) is set to be smaller than that of the second through hole 11R (11G and 11B). Therefore, the electron beams 5R1–5R3 (5G1–5G3 and 5B1–5B3) can be superimposed at one point on a predetermined phosphor dot. The cathodes may be either hot or cold cathodes. In the case of using a cold cathode, its size can be made small and it is easily produced. The electron emitting parts of cathodes are not limited to those having protrusions shown in FIGS. 6 and 7. Any configurations for emitting electrons may be used.

In the embodiment described above, the explanation was made by referring to the case where the means 8 for superimposing electron beams is provided within the electron gun 6. However, the configuration is not always limited to such. For instance, the means such as an external polarization magnetic field or the like may be provided to the peripheral surface of a cathode-ray tube located between a phosphor screen surface and a cathode in an electron gun within the cathode-ray tube, or the like.

Furthermore, the means can be also utilized for superimposing electron beams in a field emission display device besides in a monochrome or color cathode-ray tube.

The invention may be embodied in other specific forms without departing from the spirit or essential characteristics thereof The embodiment disclosed in this application is to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. A cathode-ray tube, comprising: a face-panel having a phosphor screen surface on its inner surface; a funnel connected to a rear part of the face-panel; and an electron gun that is contained in a neck portion of the funnel and emits a plurality of electron beams, wherein the plurality of electron beams are obtained from one cathode in the electron gun, and wherein a means for superimposing the plurality of electron beams on a predetermined phosphor on the phosphor screen surface is provided.

2. A cathode-ray tube, comprising: a face-panel having a phosphor screen surface on its inner surface; a funnel connected to a rear part of the face-panel; and an electron gun that is contained in a neck portion of the funnel and emits a plurality of electron beams, wherein the electron gun is provided with a means for superimposing electron beams, and wherein the electron gun comprises: cathodes for emitting electron beams; a first control electrode having a plurality of first electron-beam through holes opposing each of the cathodes respectively and being aligned in a perpendicular direction with respect to a horizontal scanning line direction of the electron beams; a second control electrode having second electron-beam through holes provided at positions opposing the first electron-beam through holes respectively; and a third control electrode having third electron-beam through holes provided at positions opposing the second electron-beam through holes respectively.

3. The cathode-ray tube according to claim 2, wherein the cathodes have a plurality of electron emitting parts opposing the first electron-beam through holes respectively.

4. The cathode-ray tube according to claim 2, wherein the pitch of the plurality of third electron-beam through holes aligned in the perpendicular direction with respect to the horizontal scanning line of the electron beams of the third control electrode is set to be narrower than that of the plurality of second electron-beam through holes aligned in the perpendicular direction with respect to the horizontal scanning line of the electron beams of the second control electrode.

5. The cathode-ray tube according to claim 2, wherein three electron-beam through holes are aligned in the perpendicular direction with respect to the horizontal scanning line direction of the electron beams of each control electrode.

6. The cathode-ray tube according to claim 5, wherein the diameters of the electron-beam through holes located at the upper and lower sides are set to be smaller than that of the electron-beam through hole located in the middle.

7. A cathode-ray tube, comprising: a face-panel having a phosphor screen surface on its inner surface; a funnel connected to a rear part of the face-panel; and an electron gun that is contained in a neck portion of the funnel and emits a plurality of electron beams, wherein the electron gun is provided with a means for superimposing electron beams, and wherein the electron gun comprises: a plurality of cathodes having an inline alignment in the horizontal direction for emitting electron beams; a first control electrode having a plurality of first electron-beam through holes opposing each of the plurality of cathodes respectively and being aligned in a perpendicular direction with respect to a horizontal scanning line direction of the electron beams; a second control electrode having second electron-beam through holes provided at positions opposing the first electron-beam through holes respectively; and a third control electrode having third electron-beam through holes provided at positions opposing the second electron-beam through holes respectively.

8. The cathode-ray tube according to claim 7, wherein each cathode has a plurality of electron emitting parts opposing the first electron-beam through holes aligned in the perpendicular direction with respect to the horizontal scanning line of the electron beams respectively.

9. A cathode-ray tube, comprising: a face-panel having a phosphor screen surface on its inner surface; a funnel connected to a rear part of the face-panel; and an electron gun that is contained in a neck portion of the funnel and emits a plurality of electron beams, wherein the electron gun is provided with a means for superimposing electron beams, and wherein the electron gun comprises: a cathode having a plurality of electron emitting parts for emitting electron beams, the plurality of electron emitting parts being aligned in a perpendicular direction with respect to a horizontal scanning line direction of the electron beams; a first control electrode having a first electron-beam through hole common for the plurality of electron emitting parts of the cathode; a second control electrode having a second electron-beam through hole provided at a position opposing the first electron-beam through hole; and a third control electrode having a third electron-beam through hole provided at a position opposing the second electron-beam through hole.

10. The cathode-ray tube according to claim 9, wherein the diameter of the third electron-beam through hole is set to be smaller than that of the second electron-beam through hole.

11. A cathode-ray tube, comprising: a face-panel having a phosphor screen surface on its inner surface; a funnel connected to the perimeter edge of the inner surface of the face-panel; and an electron gun that is contained in a neck portion of the funnel and emits a plurality of electron beams, wherein the electron gun is provided with a means for superimposing electron beams, and wherein the electron gun comprises: a plurality of cathodes having an inline alignment in the horizontal direction, each of the plurality of cathodes having a plurality of electron emitting parts for emitting electron beams, the plurality of electron emitting parts being aligned in a perpendicular direction with respect to a horizontal scanning line direction of the electron beams; a first control electrode having first electron-beam through holes opposing each of the plurality of cathodes, each of the first electron-beam through holes being common for one group of the plurality of electron emitting parts aligned in the perpendicular direction with respect to the horizontal scanning line direction of the electrons beams; a second control electrode having a second electron-beam through hole provided at a position opposing the first electron-beam through hole; and a third control electrode having a third electron-beam through hole provided at a position opposing the second electron-beam through hole.

* * * * *